US005323675A

United States Patent [19]

Rolland

[11] Patent Number: 5,323,675

[45] Date of Patent: Jun. 28, 1994

[54] BOW FOR A STRING INSTRUMENT

[76] Inventor: Benoît M. P. Rolland, 13, rue du Fourchi, 14800 Touques, France

[21] Appl. No.: 854,650

[22] PCT Filed: Nov. 19, 1991

[86] PCT No.: PCT/FR91/00911

§ 371 Date: Jul. 10, 1992

§ 102(e) Date: Jul. 10, 1992

[87] PCT Pub. No.: WO92/09068

PCT Pub. Date: May 29, 1992

[30] Foreign Application Priority Data

Nov. 20, 1990 [FR] France ..... 90 14423

[51] Int. Cl.[5] ..... G10D 1/02

[52] U.S. Cl. ..... 84/282

[58] Field of Search ..... 84/282, 325, 10

[56] References Cited

U.S. PATENT DOCUMENTS 2,234,682 3/1941 Notter ..... 84/282

FOREIGN PATENT DOCUMENTS 128437 2/1902 Fed. Rep. of Germany .
85912 2/1985 Fed. Rep. of Germany .
458898 8/1968 Switzerland .

*Primary Examiner*—Michael L. Gellner
*Assistant Examiner*—Cassandra Spyrou
*Attorney, Agent, or Firm*—Foley & Lardner

[57] ABSTRACT

A bow equipped with an improvement enabling adjustment of its rigidity. According to the invention, a longitudinal recess is made in the stick of the bow and this recess encloses a core stiffener linked to a screw-nut system (26–27) actuated by a knob (32). The stick can, for instance, be of molded synthetic material.

10 Claims, 1 Drawing Sheet

BOW FOR A STRING INSTRUMENT

BACKGROUND OF THE INVENTION

1. Field of the Invention

The invention relates to a bow for stringed musical instrument and particularly concerns an improvement to the stick of this bow, enabling adjustment of the stiffness thereof.

2. Description of the Related Art

A classical bow is composed of a curved stick with a widened hatched-shaped head and equipped at the other end with an adjustable frog. A horsehair ribbon is stretched between the head and the frog using a screw and nut system. Conventionally, the stick is cut from a fairly rare hard and resistant brazilwood, Pernambuco. More recently, it was proposed to make this stick of a synthetic material, usually composite such as a carbon-fibre based or similar material.

The qualities of a bow depend essentially on the characteristics of the stick, such as its curve and its greater or lesser rigidity. In fact, one same bow may be considered satisfactory by one instrumental performer yet disliked by another. Indeed, the best instrumentalists consider it necessary to change the bow to suit the musical work being performed, or merely their sensitivity of the moment. This therefore causes them to possess several bows. Yet, good bows are expensive.

Also, bows in a synthetic material, if reproducible on an industrial scale, are too similar in characteristics from one model to another to satisfy all instrumentalists. Indeed, one cannot conceive of an ideal bow to suit all instrumentalists, precisely because of the varied, and sometimes even contradictory, demands of these latter. Such variety, which can be obtained by a skilled craftsman making each bow individually, raises difficulties for manufacture on an industrial scale.

SUMMARY OF THE INVENTION

Among its other qualities, the invention provides a solution for these problems by proposing a bow structure which enables varying the mechanical characteristics of the stick. In particular, it enables an adjustment of the rigidity of any bow equipped with this improvement.

In this spirit, the invention essentially concerns a bow comprising a curved stick, and a first screw-nut system for horsehair tension. The screw is actuated by a first knob situated at the end of the stick and the nut. It includes a longitudinal recess extending substantially up to its head, a core stiffener being lodged in this recess and linked to a second screw-nut system coaxial to the first.

The term core stiffener refers to any rod or thread suitable to be tensioned or, on the contrary, axially compressed by the screw-nut system inside the longitudinal recess, in order to significantly modify the rigidity of the stick.

This improvement therefore enables an instrumentalist to adapt the bow to his style of playing or his repertoire.

The invention is particularly well suited for a bow including a stick of a synthetic material of the type mentioned above, a bow adaptable to the instrumentalist's wishes since it enables, from a reproducible stick structure with precise characteristics.

BRIEF DESCRIPTION OF THE DRAWINGS

A better understanding and clearer view of the other advantages of the invention can be obtained from the following description, given solely as an example and in reference to the appended drawings, in which.

DETAILED DESCRIPTION OF THE PREFERRED EMBODIMENTS

Figure 1:
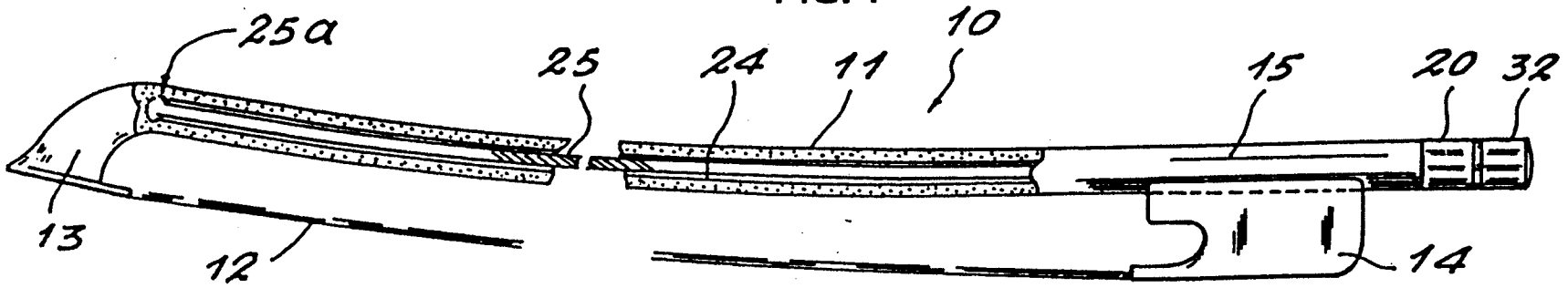
FIG. 1 is partial longitudinal section, partially cut away of a bow complying with the invention.
Figure 2:
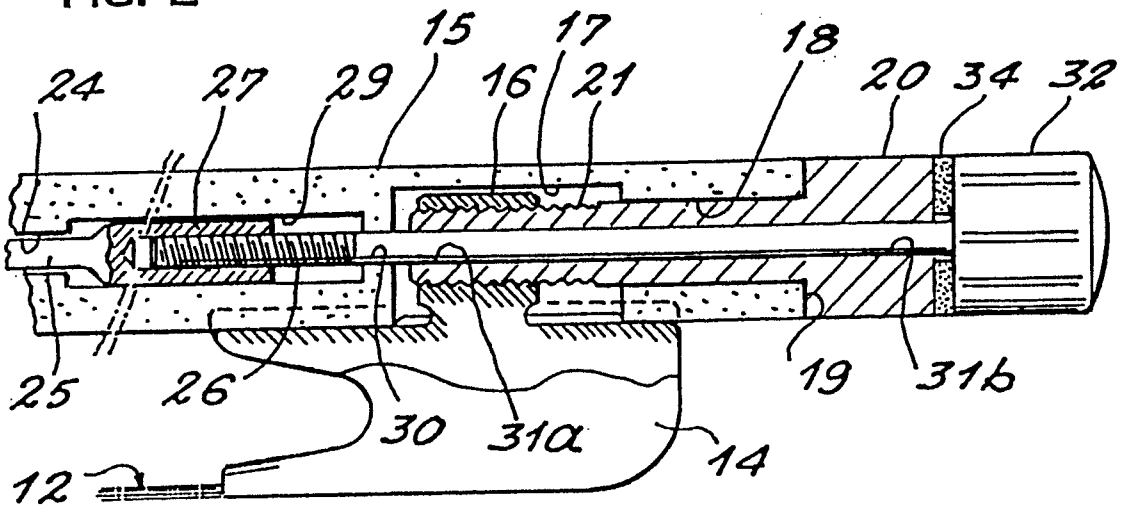
FIG. 2 is a partial cross-section on a larger scale of the handle of the bow shown in FIG. 1.

Referring to FIGS. 1 and 2 in particular, we show a bow 10 comprising a curved stick 11 of conventional appearance, and a horsehair hank 12 stretched between the head 13 and a frog 14 whose position is adjustable along a handle 15 of the said stick. This rectilinear handle is octagonal in cross-section and serves to guide the frog 14, which for this purpose has a groove open on three longitudinal facets espousing the shape of the lateral surface of the handle. The frog 14 comprises a nut 16 lodged in a mortise 17 cut out in the frog. This latter is in addition drilled with an axial hole 18 opening to extremity 19 near to where a first knob 20 incorporating a screw 21 is located. This latter is inserted in the hole 18 and the mortise 17 and fits into the nut 16. This first screw-nut system (21–16) enables the position of frog 14 and consequently the tension of the hairs to be adjusted.

The design as described hereabove is that of any conventional bow.

According to the invention, the stick 11 is hollow and comprises a longitudinal recess 24 extending along virtually its entire length up to the region of the head 13. This groove contains a core stiffener 25, this latter being linked to a second screw-nut system (26–27) coaxial to the first. This second screw-nut system is provided in order to subject the core stiffener to tensile or compressive stress, depending on the chosen assembly. Depending on the stress exerted on the core stiffener, it is possible to modify and adjust the rigidity of the stick.

As shown in FIG. 2, the nut 27 of the second screw-nut system is lodged in a cavity 29 near to the said mortise. In addition, the screw 21 of the first screw-nut system is tubular (it has a hole 31*a* drilled along its axis) and is traversed longitudinally by the screw 26 of the second screw-nut system. The nut 27 is of cap nut type and is fixed to core stiffener 25. The cavity 29 and the mortise 17 communicate via axial hole 30 to enable the passage of screw 26. This latter also extends through an axially drilled hole 31*b* of the knob 20 extending the hole of screw 21, and is fixed to a second knob 32. In the example described in reference to FIGS. 1 and 2, the second screw-nut is clearly designed to exert tensile stress on the core stiffener 25. In this case, this latter must be anchored near to head 13, by a widening 25*a*. It can be of synthetic (nylon or other) material or in metal. Of the example shown, the two knobs 20 and 32 are separated by a spacer 34 in an antifriction material such as polytetrafluorethylene, for instance. A recess 24 enclosing the core stiffener is advantageously filled with silicone grease or a similar substance or material to enable easy sliding of the core.

As mentioned earlier, the stick 11 can be of a moulded synthetic material, which greatly facilitates manufacture.

Figure 3:
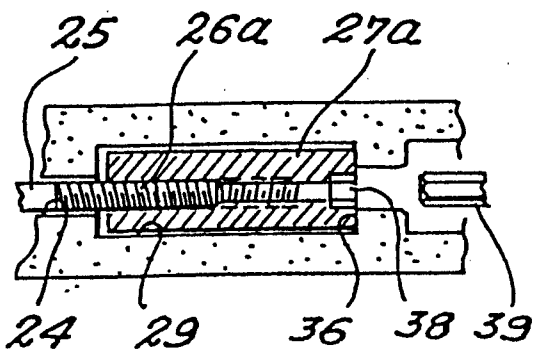
FIG. 3 is a detailed cross-section illustrating an alternative.

In the embodiment shown in FIG. 3, the second screw-nut system (26*a*–27*a*) is designed to exert compression on the core stiffener 25. In this case, this latter is of metal. The screw 26*a* here consists of a threaded portion of the corresponding end of the core, whereas the nut 27*a* is a segment with a blind hole threaded on the inside. This segment rests against an internal abutment 36 of the stick, here an axial end wall of the cavity 29. The nut 27*a*, in this instance, comprises a so-called hexagonal hole 38 to manipulate the screw-nut system using a hexagonal key 39, this latter being inserted via tubular screw 21 and knob 20 of the first screw-nut system.

What is claimed:

1. A bow comprising:

a curved hollow stick member having a first and a second end;

a longitudinal recess within said stick member and extending substantially from said first end to said second end;

a bow head disposed at said first end;

said second end having a mortise;

a first screw-nut system for horsehair tension including:

a first knob attached to said second end;

a first nut lodged in the mortise;

a first screw attached to said first knob and engaging said first nut;

a frog linked to said first nut;

a core stiffener positioned in said recess; and a second screw-nut system coaxial with said first screw-nut system and linked to said core stiffener and including:

a second nut linked to said core stiffener; and a second screw engaging said second nut.

2. Bow as claimed in claim 1, wherein the stick member comprises a cavity adjacent to the mortise, the second screw-nut system is positioned in the cavity, the first screw is tubular and the second screw longitudinally traverses the first screw.

3. Bow as claimed in claim 1, wherein the core stiffener is made of synthetic material and is anchored adjacent to the head of the stick member and wherein the second screw-nut system is mounted to exert tensile stress on the core stiffener.

4. Bow as claimed in claim 1, wherein the core stiffener is made of metal and is anchored adjacent near the head of the stick member and wherein the second screw-nut system is mounted to exert tensile stress on the core stiffener.

5. Bow as claimed in claim 1, wherein the first screw and the first knob form a tubular element, the second screw traverses the tubular element longitudinally and the second screw is fixed to a second knob extending in axial relationship to the first knob.

6. Bow as claimed in claim 5, further comprising a spacer between the first knob and the second knob, the spacer being made of an antifriction material.

7. Bow as claimed in claim 1, wherein the core stiffener is made of metal and wherein the second screw-nut system is mounted to exert compressive stress on the core stiffener.

8. Bow as claimed in claim 7, wherein the second screw of the second screw-nut system is formed by a threaded end portion of the core stiffener and wherein the stick member includes a fixed internal abutment, the second nut resting against the abutment.

9. Bow as claimed in claim 1, further comprising a substance to enable easy sliding of the core stiffener enclosed in the longitudinal recess.

10. Bow according to claim 1, wherein the stick member is made of synthetic material.

* * * * *